US008333297B2

(12) United States Patent
McAlpine et al.

(10) Patent No.: US 8,333,297 B2
(45) Date of Patent: Dec. 18, 2012

(54) SLIDE AND CLIP-IN CORNER SUPPORT

(75) Inventors: Gilroy Clements McAlpine, Benoni (ZA); Daniel Robert Algate, Kempton Park (ZA)

(73) Assignee: Gilroy Clements McAlpine (ZA)

( * ) Notice: Subject to any disclaimer, the term of this patent is extended or adjusted under 35 U.S.C. 154(b) by 612 days.

(21) Appl. No.: 12/091,561

(22) PCT Filed: Oct. 31, 2006

(86) PCT No.: PCT/IB2006/054022

§ 371 (c)(1),
(2), (4) Date: Jul. 9, 2008

(87) PCT Pub. No.: WO2007/052215

PCT Pub. Date: May 10, 2007

(65) Prior Publication Data

US 2008/0257897 A1 Oct. 23, 2008

(30) Foreign Application Priority Data

Nov. 3, 2005 (ZA) ..... 2005/8904

(51) Int. Cl.
*B65D 6/34* (2006.01)

(52) U.S. Cl. ..... 220/652; 220/650; 220/628; 220/666; 220/6

(58) Field of Classification Search ..... 220/652, 220/660, 650, 651, 605, 628, 6, 666; 229/198.1, 229/198.2, 198.3, 199; 206/652
See application file for complete search history.

(56) References Cited

U.S. PATENT DOCUMENTS

| | | | | |
|---|---|---|---|---|
| 1,573,112 | A | 2/1926 | Gerding et al. | |
| 2,858,037 | A * | 10/1958 | Rose | 217/65 |
| 4,120,444 | A | 10/1978 | Gray | 229/49 |
| 4,341,338 | A * | 7/1982 | Arnold | 229/122.21 |

(Continued)

FOREIGN PATENT DOCUMENTS

| | | |
|---|---|---|
| DE | 40709 | 1/1887 |
| DE | 200772 | 12/1906 |
| EP | 0 573 729 | 12/1993 |
| GB | 870751 | 6/1961 |

OTHER PUBLICATIONS

International Search Report mailed Mar. 15, 2007 in PCT International Application No. PCT/IB2006/054022.

*Primary Examiner* — Mickey Yu
*Assistant Examiner* — Kareen Rush
(74) *Attorney, Agent, or Firm* — Ostrolenk Faber LLP

(57) ABSTRACT

The invention provides a reinforcing corner post suitable for use with a container comprising a foldable blank having a base panel and a pair of opposed side wall panels, and a pair of opposed end wall panels, the side wall panels and end wall panels being foldable into upright positions relative to the base panel to define opposed side walls and end walls with corners being formed at the junctions of the side walls and end walls, the reinforcing corner post being provided at all or selected corners of the container, wherein the corner post comprises an external post section which embraces the corner, and an internal post section which nests within the corner, and engaging means for releasably coupling the external post section and internal post section to one another by longitudinal displacement of the external post section and internal post section relative to one another to an engaged position, and locking means for securing the inner post section and the outer post section in the engaged position.

15 Claims, 14 Drawing Sheets

U.S. PATENT DOCUMENTS 5,037,027 A * 8/1991 Nichols ..... 229/198.1
5,799,797 A * 9/1998 Braun ..... 206/586
6,286,683 B1 * 9/2001 Hunt et al. ..... 206/586
6,749,077 B1 * 6/2004 McAlpine et al. ..... 220/4.29
7,111,735 B2 * 9/2006 Lowry ..... 206/586
7,841,469 B2 * 11/2010 Muyskens ..... 206/453
8,079,119 B1 * 12/2011 Ferko, III ..... 27/4

* cited by examiner

SLIDE AND CLIP-IN CORNER SUPPORT

CROSS-REFERENCE TO RELATED APPLICATIONS

The present application is a 35 U.S.C. §§371 national phase conversion of PCT/IB2006/054022, filed Oct. 31, 2006, which claims priority of South African Patent Application No. 2005/08904, filed Nov. 3, 2005, the disclosure of which has been incorporated herein by reference. The PCT International Application was published in the English language.

FIELD OF THE INVENTION

THIS invention relates to a container and reinforcing corner posts for use with the container in its erected configuration.

BACKGROUND TO THE INVENTION

Various collapsible containers are available. These are particularly useful for produce such as fruit and vegetables, but are not confined to the conveyance and storage of such produce.

Known collapsible containers suffer from the disadvantage that they are relatively complicated to erect for use and to collapse for storage and transport purposes, and are consequently not widely accepted by users. Furthermore, known collapsible containers often lack strength and rigidity, and are consequently easily deformed in use resulting in damage to goods contained therein. Consequently also such known containers are not suitable for permanent packaging or storage systems.

OBJECT OF THE INVENTION

It is accordingly an object of the present invention to provide a novel container and reinforcing corner posts therefor which seeks to overcome or at least minimize the above mentioned disadvantages, or which will provide a useful alternative to known containers.

SUMMARY OF THE INVENTION

According to the present invention, there is provided a reinforcing corner post suitable for use with a container comprising a foldable blank having a base panel and a pair of opposed side wall panels, and a pair of opposed end wall panels, the side wall panels and end wall panels being foldable into upright positions relative to the base panel to define opposed side walls and end walls with corners being formed at the junctions of the side walls and end walls, the reinforcing corner post being provided at all or selected corners of the container, characterized in that the corner post comprises an external post section which embraces the corner, and an internal post section which nests within the corner, and engaging means for releasably coupling the external post section and internal post section to one another by longitudinal displacement of the external post section and internal post section relative to one another to an engaged position, and locking means for securing the inner post section and the outer post section in the engaged position.

Preferably, the inner post section and the outer post section will each comprise generally planar longitudinally extending leaf elements which are angled relative to one another, meeting at a longitudinal junction to define a longitudinal corner formation. Preferably also, the leaf elements will include transverse and/or longitudinal reinforcing ribs.

Further according to the invention, the engaging means comprises tongue elements which extend from one post section and engage complementary formations in the other post section upon relative longitudinal displacement between such sections.

In a preferred arrangement the tongue formations will extend outwardly from the inner post section and engage corresponding longitudinal slots provided in the outer post section.

Thus in one arrangement, the tongue formations will extend outwardly from an inner post section and each tongue formation will terminate in a head formation which is adapted to be held captive by a corresponding slot in the outer post section upon relative longitudinal displacement between the post sections to the engaged position.

Further according to the invention, at least some of the slots which engage the head formations of the tongue formations include a ramp section which acts to draw a tongue formation into a slot formation to a greater depth. This feature of the invention has the result that the inner post section and the outer post section are drawn closer together so as to sandwich and preferably clamp a corner of the container within the embrace of the post sections in a sandwich fashion.

Also according to the invention one of the post sections, preferably the outer post section is provided with a low level platform structure which is adapted to extend beneath a corner of the container, and which is provided with an engagement formation which is engaged by a corresponding engagement formation on the inner post section to clip the inner and the outer post sections in the engaged position. Preferably, the engagement formation on the platform structure is in the nature of one or more apertures which, in use, receive spigots therein which extend from the inner post section and which have outwardly directed collars which clip into the apertures. This arrangement of the invention acts to clip the inner post section and the outer post section into their engaged position.

The invention envisages that further locking means may be provided for securing the inner post section and the outer post section in the engaged position, such locking means comprising a disc which is receivable in a channel which follows the inner periphery of the outer post section and against which disc the inner post section abuts to prevent relative longitudinal displacement between the inner post section and the outer post section.

It is further a preferred feature of the invention that retention means will be provided for locking the disc in position on the corner post. In one arrangement such locking means may comprise a hook formation which engages a step structure provided in the channel. Additionally, the disc may have apertures through which upstanding spigot formations on the inner post section extend and which engage the spigot formations in a snap type locking action.

A further feature of the invention comprises extending the outer post sections so that these project above the upper level of the container to constitute stacking corners within which the lower zone of an overlying container is received. It has been found that such stacking corners stabilize a plurality of stacked containers.

Also included within the scope of the present invention is a container having corner posts as defined above.

BRIEF DESCRIPTION OF THE DRAWINGS

In order more clearly to illustrate the invention an embodiment thereof is described hereunder as an example, without limiting the scope of the invention comprising.

BRIEF DESCRIPTION OF PREFERRED EMBODIMENT

Figure 1:
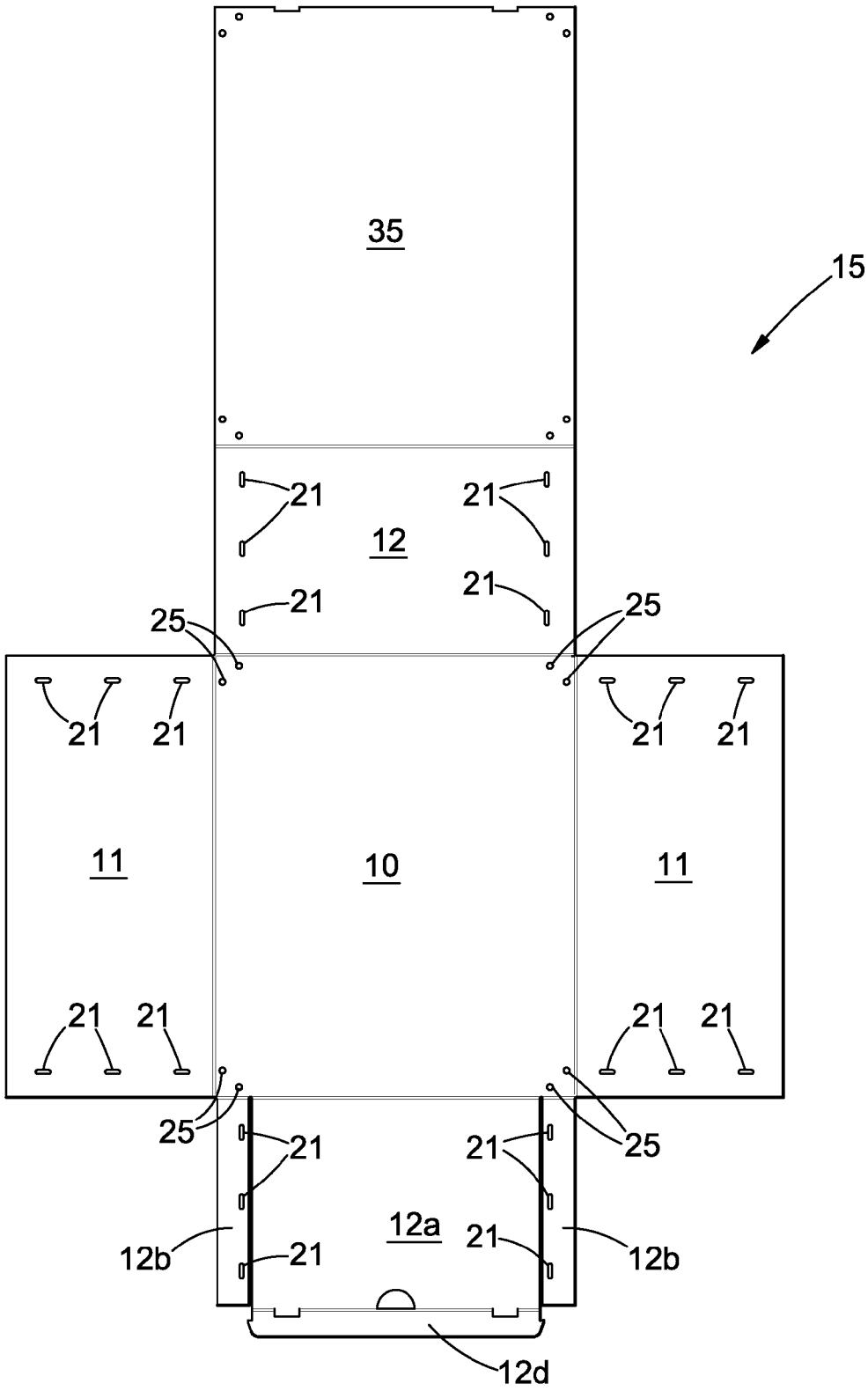
FIG. 1 is a plan view of a blank of sheet material forming part of a collapsible container in accordance with the invention.

Referring to the drawings, a collapsible container 13 in accordance with the invention comprises a blank 15 having a base panel 10, opposed side panels 11 and opposed end panels 12 which are adapted to be folded to an upright position relative to the base panel 10 to form opposed side walls 11 and opposed end walls 12 of the container 13. Corners 14 of the container 13 are formed at the intersection between the side walls 11 and end walls 12 as illustrated (FIGS. 2, 3).

Figure 2:
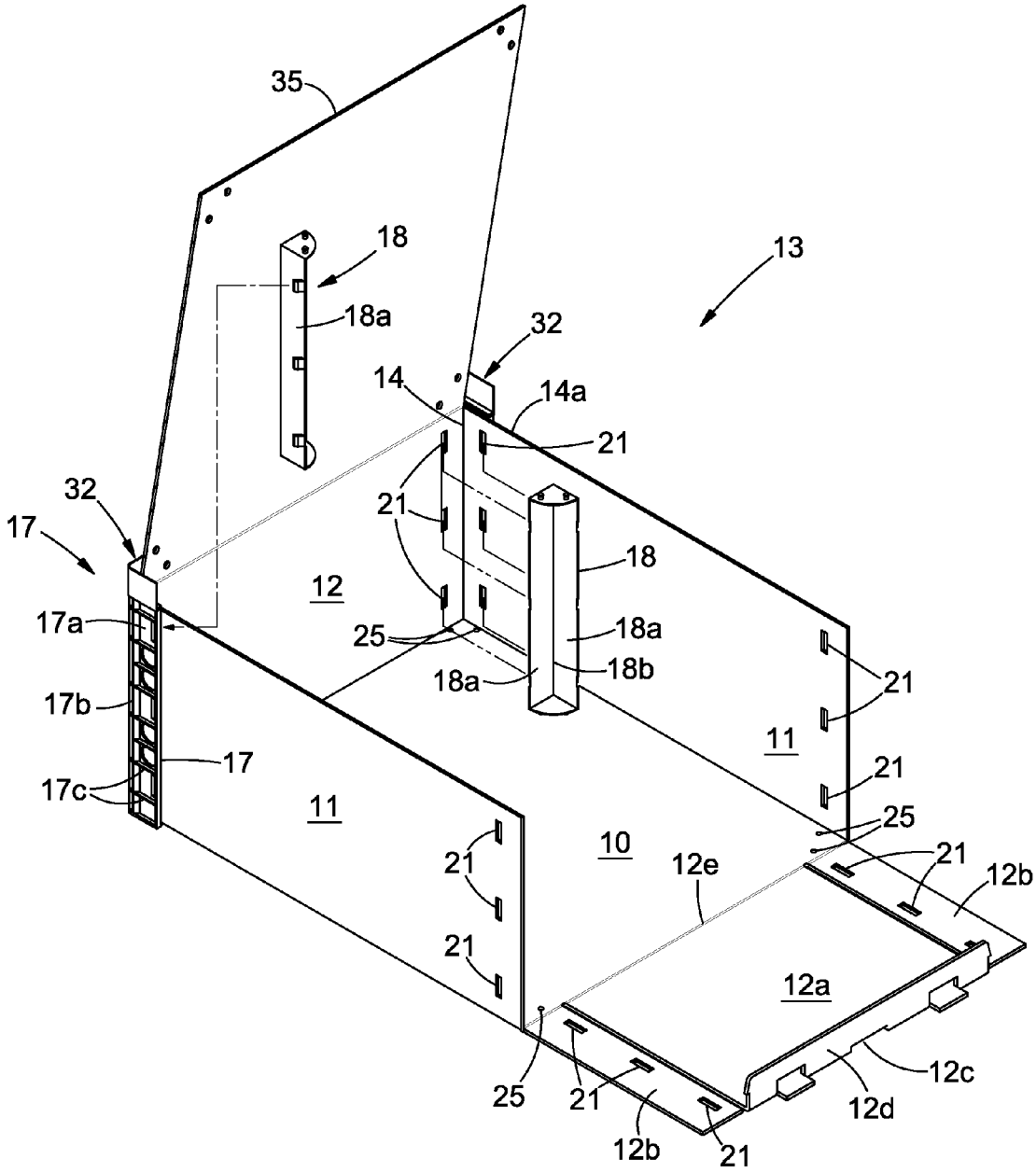
FIG. 2 is a schematic perspective view of a partially erected collapsible container in accordance with the invention, wherein side wall panels and one end wall panel have been folded to an upright position, and wherein two corner posts are partially installed.
Figure 3:
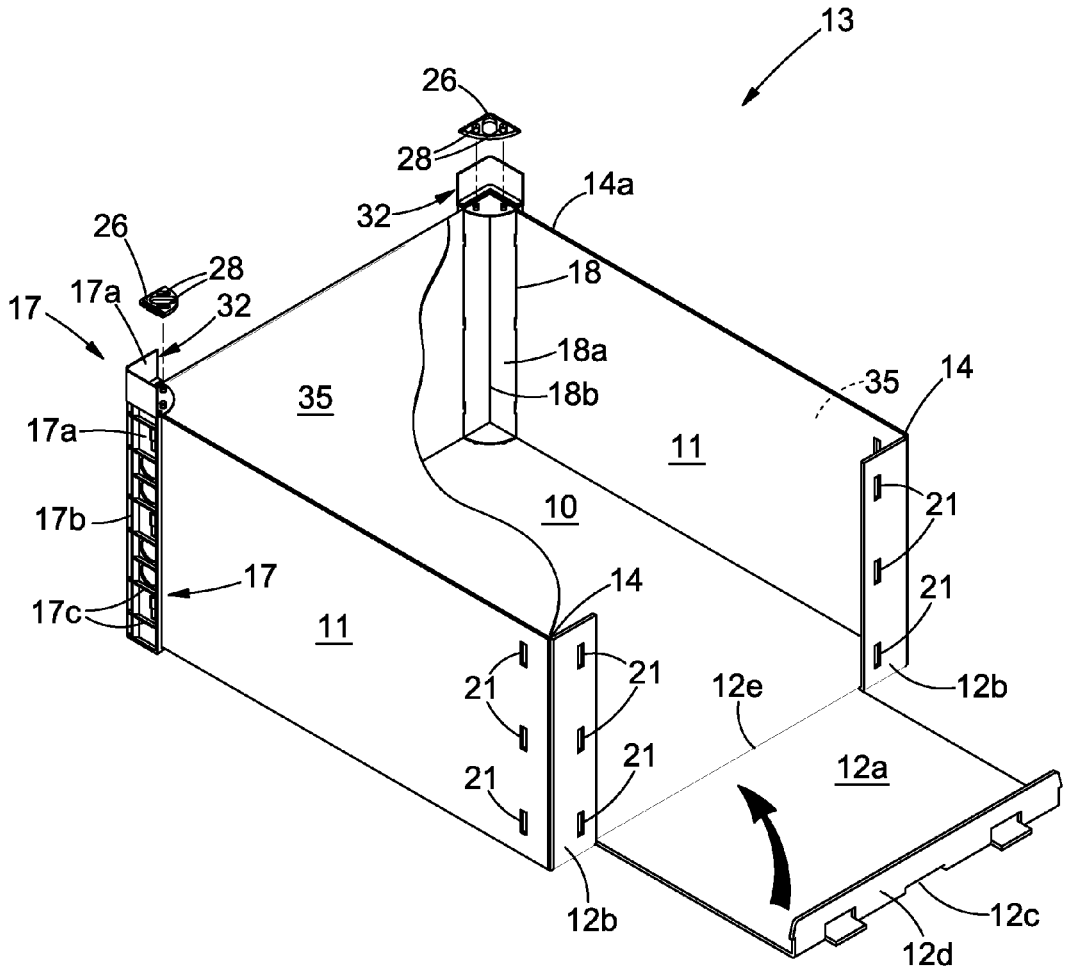
FIG. 3 is a schematic perspective view of the container in FIG. 2 which has been erected to an extent wherein two reinforcing corner posts are partially installed.
Figure 4:
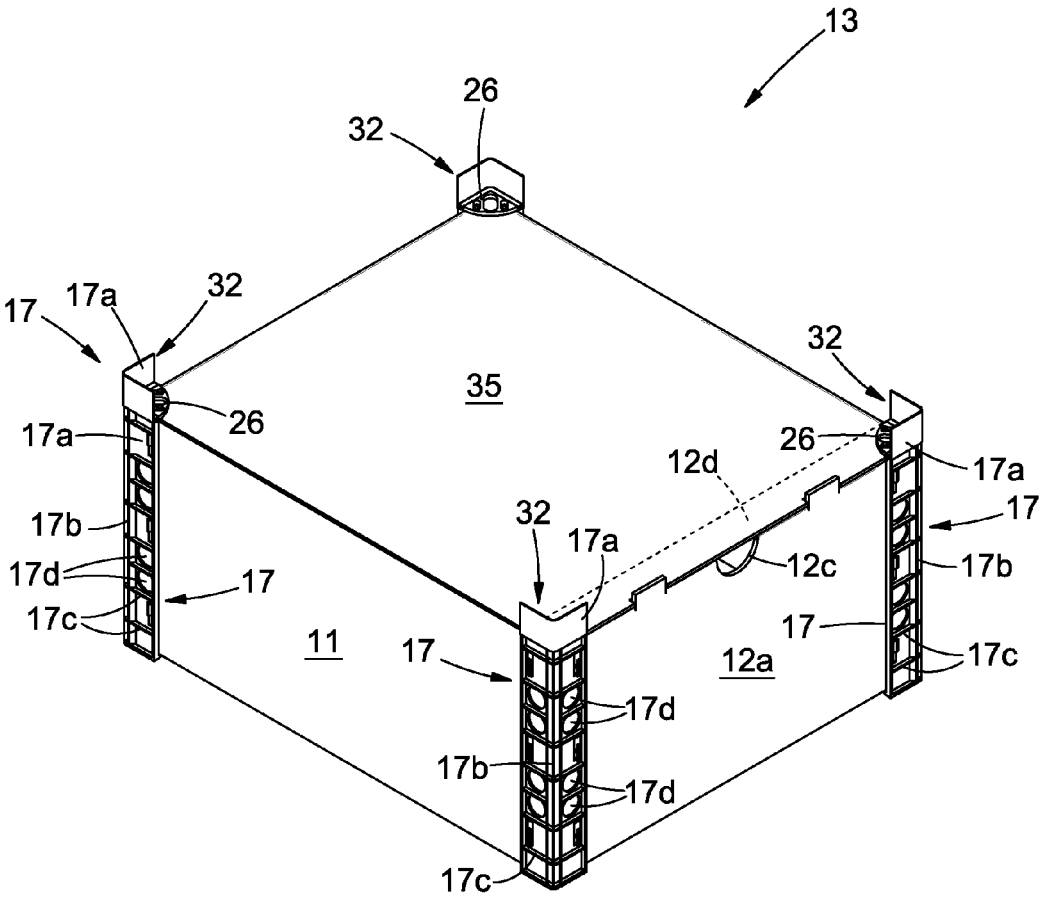
FIG. 4 is a schematic perspective view of the carton in FIG. 2 in a fully erected configuration, but without a lid which is an alternate arrangement, not illustrated.

FIGS. 2 to 4 illustrate the various steps which are taken to fold the blank in FIG. 1 into an erected container having reinforcing corner posts 17, as shown in FIG. 4. The container in FIGS. 2 to 4 includes one end panel 12*a* which is hinged along a fold-line 12*e* to enable the panel 12*a* to fold to an open position. The panel 12*a* has an end tab 12*d* and a manipulating aperture 12*c*. Side tabs 12*b* are hinged at right angles to the floor panel 10 and form corners 14 together with the side panels 11 (FIG. 3). This type of arrangement is particularly suitable for a storage system wherein access to the interior of the container is required. Such storage containers will normally be provided with a lid structure which is shown at 35. Such a lid structure 35 could take various forms which are all included in this disclosure and could hinge from one of the end walls 12 and be secured to the other end wall 12 by means of suitable tabs, not shown.

It is a feature of the invention that all or selected corners 14 of the container are reinforced by means of a composite reinforcing corner post 16. Each reinforcing post 16 comprises an outer post section 17 which embraces the outside of a corner 14, and an inner post section 18 which is a snug fit within the corner 14 so that the corner 14 is sandwiched between the outer post section 17 and the inner post section 18 in use (FIGS. 2 to 4). Thus, each post section 17, 18 comprises a pair of longitudinal leaf formations 17*a*, 18*a* which are angled to one another at right angles at a longitudinal junction 17*b*, 18*b* to match the right angled shape of a corner 14. Preferably, the post sections 17 will be provided with a plurality of spaced transverse rib formations 17*c* in order to reinforce the sections. The post sections 17 could also be provided with cutouts 17*d* in the form of apertures, in suitable positions, in order to save material from which the post sections 17 are moulded.

Figure 8:
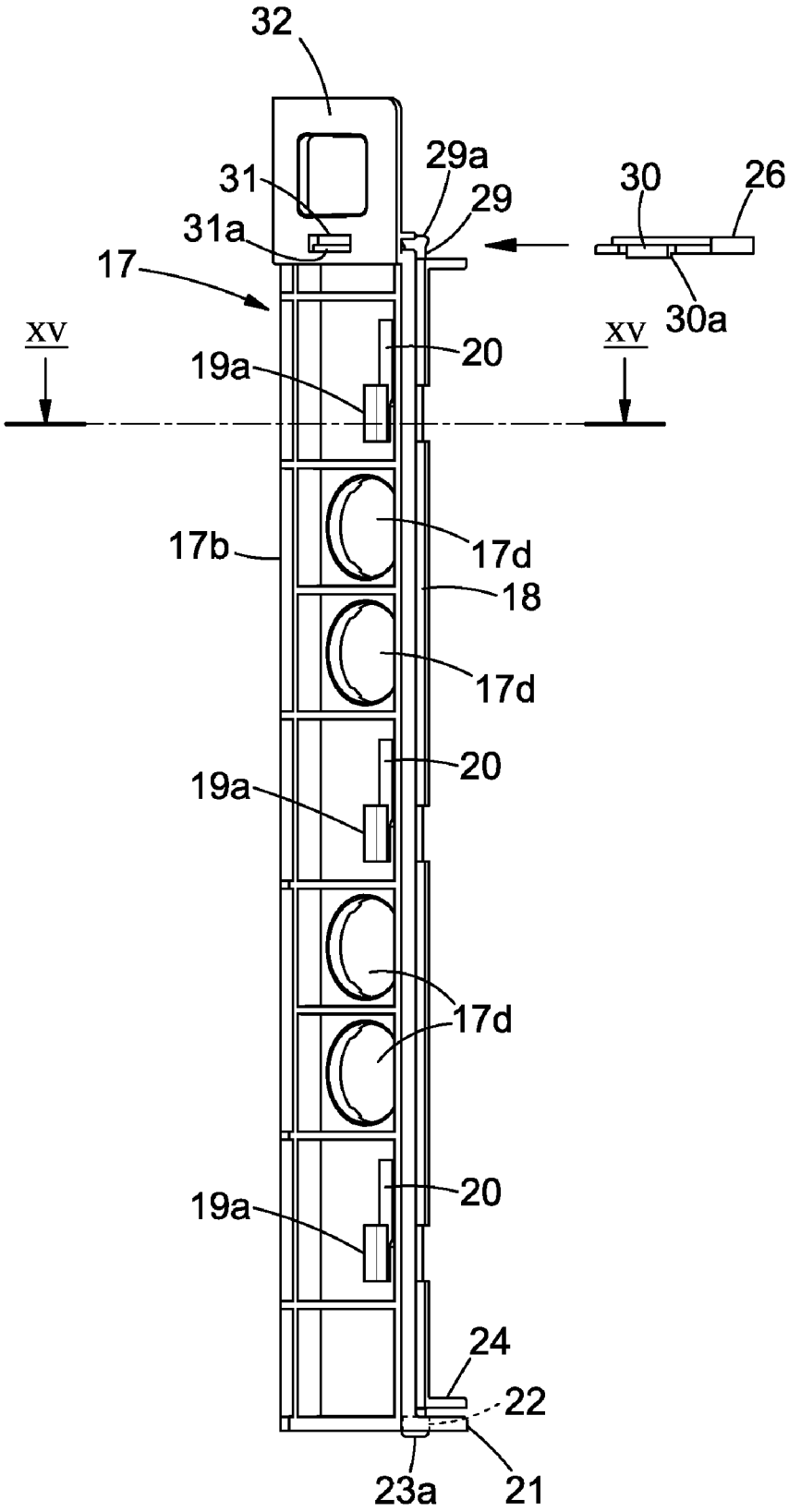
Figure 10:
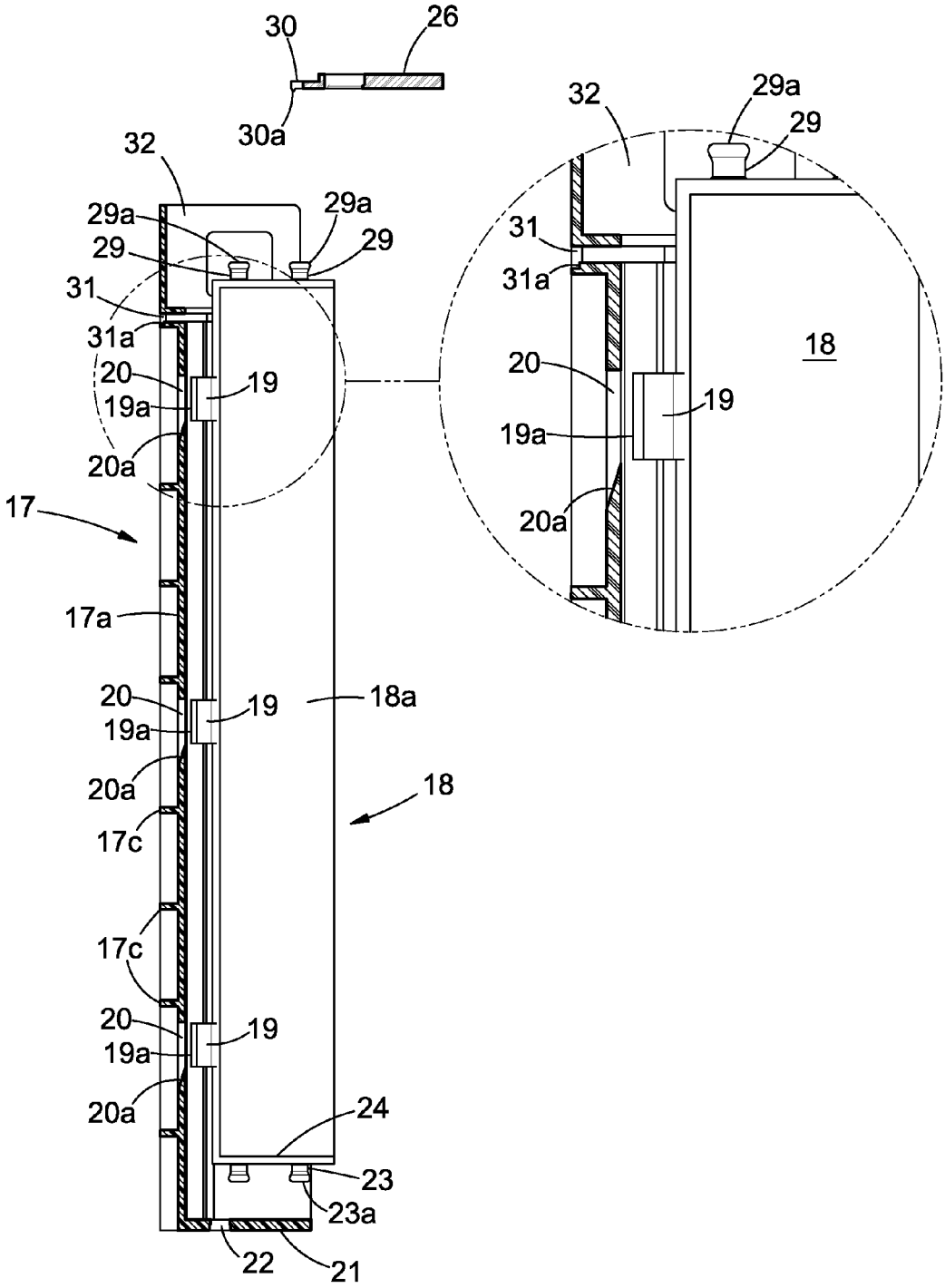
FIGS. 10 to 11 are schematic elevations which illustrate in more detail the step of connecting the outer and inner sections as shown in FIGS. 7 and 8.
Figure 11:
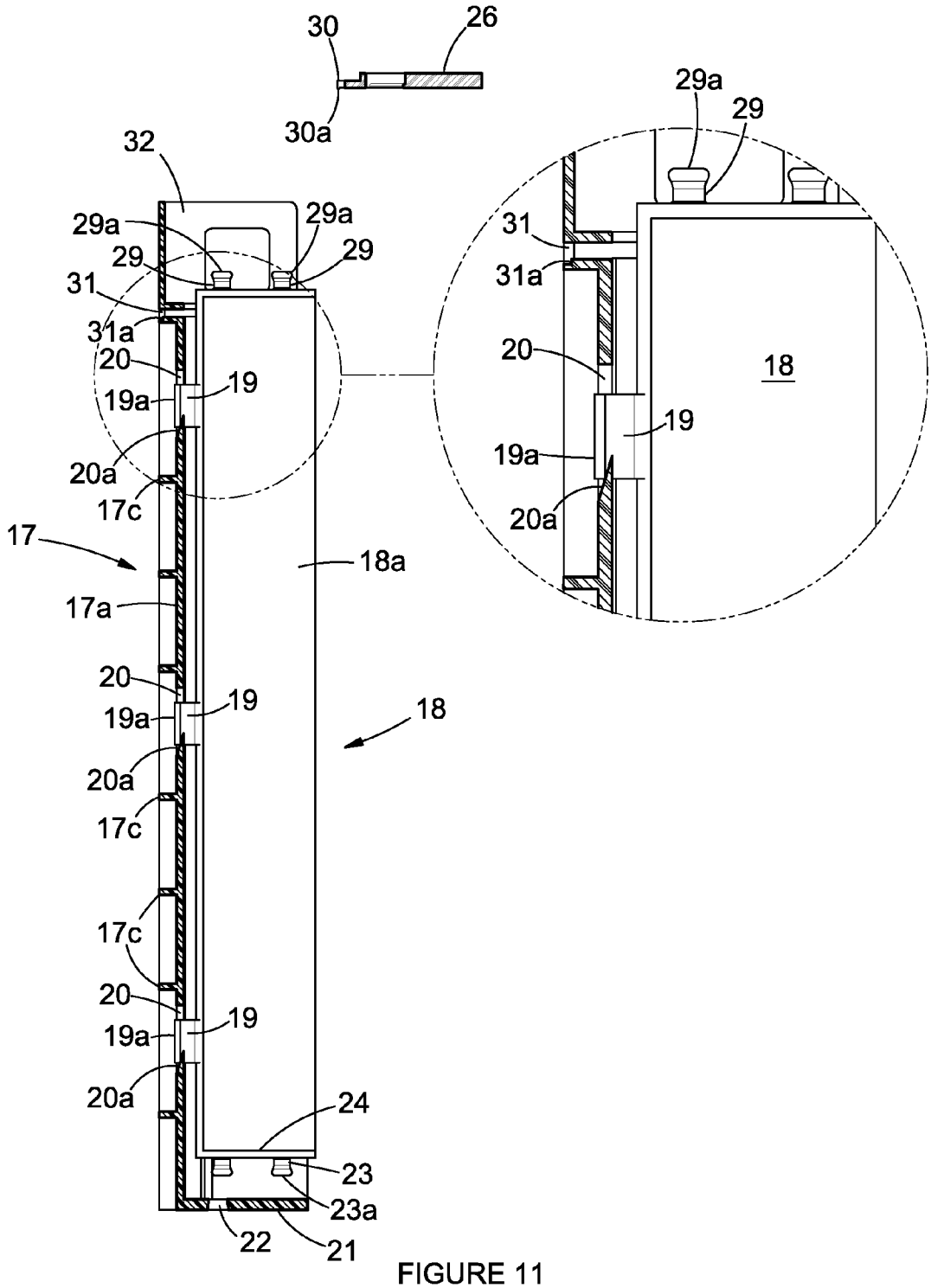
Figure 12:
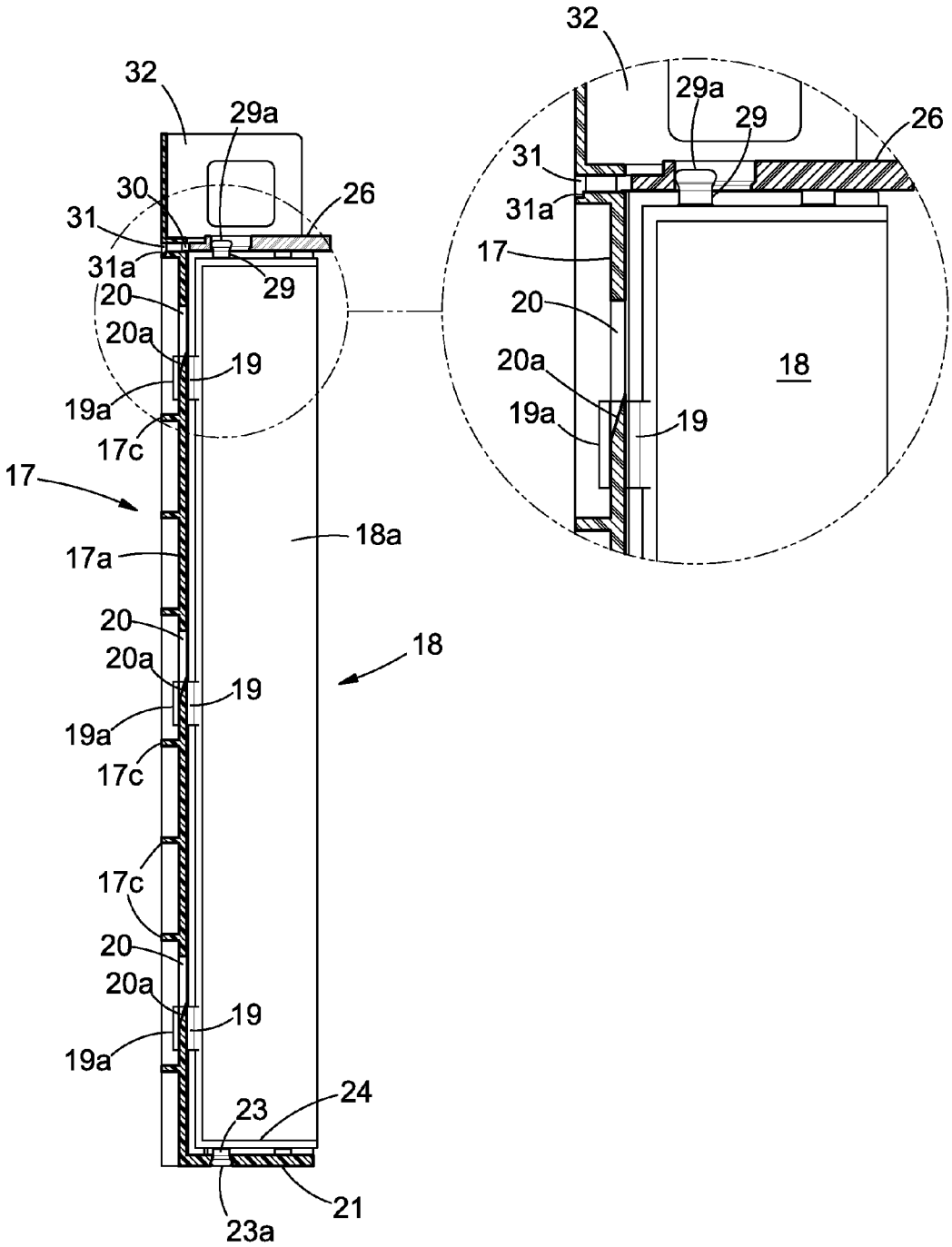
FIGS. 12 and 13 are schematic elevations which illustrate in more detail the steps of inserting the locking disc into position as shown in FIGS. 8 and 9.

It is a feature of the present invention that each inner post section 18 will be coupled to an associated outer post section 17 by means of engaging means extending from one section and which engages complementary engaging means on the other section. The engaging means releasably engage one another upon relative longitudinal movement between the inner post section 18 and the outer post section 17, to an engaged position shown in FIG. 8 and FIG. 10. Preferably the engaging means will comprise a series of tongue elements 19 which protrude laterally from the inner section 18, and engage a corresponding series of slot formations 20 provided in the outer post section 17. With such an arrangement, it is preferred that each tongue element 19 terminates in a head formation 19*a*, which is held captive in a corresponding slot formation 20 when the post sections 17, 18 are in the engaged position. It is thus envisaged that the slot formation 20 will be formed to allow access of the head formation 19*a* mentioned above as shown in FIGS. 8, 10 and 11, but terminate in a narrow configuration to trap the head formation 19*a* once the inner post section 18 and the outer post section 17 have been moved longitudinally relative to one another to the engaged position.

Preferably also, the slot formation 20 will include a ramp 20*a* which engages the head formation 19*a*, and which acts to draw the tongue 19 to a deeper extent into the slot formation 20, thereby to draw the inner and outer post sections 17, 18 towards one another and acting to clamp the corner 14 of the container 13 between the post sections 17, 18 in the engaged position. It is thus envisaged that the tongue elements 19 will pass through apertures 21 provided in the side wall panels 11 and the end wall panels 12, which intersect to provide a corner structure 14 (FIGS. 2, 3).

It has been found that the above arrangement has the advantage that the end zones of the side panels 11 and the end panels 12 which fit between the inner post section 18 and the outer post section 17 are compressed or clamped between the inner post section 18 and the outer post section 17 when the post sections 17, 18 are moved to the engaged position. Such an arrangement therefore results in a compact corner arrangement.

Preferably, the tongue elements 19 will extend from the internal post sections 18 and the slot formations will be defined in the outer post sections 17 as mentioned above, although the reverse is also possible.

In an alternative arrangement, the tongue elements 19 could be adapted to pierce the material of a corner formation 14 in the container 13, and a suitable material to permit such piecing could be used for the container 13.

Figure 5:
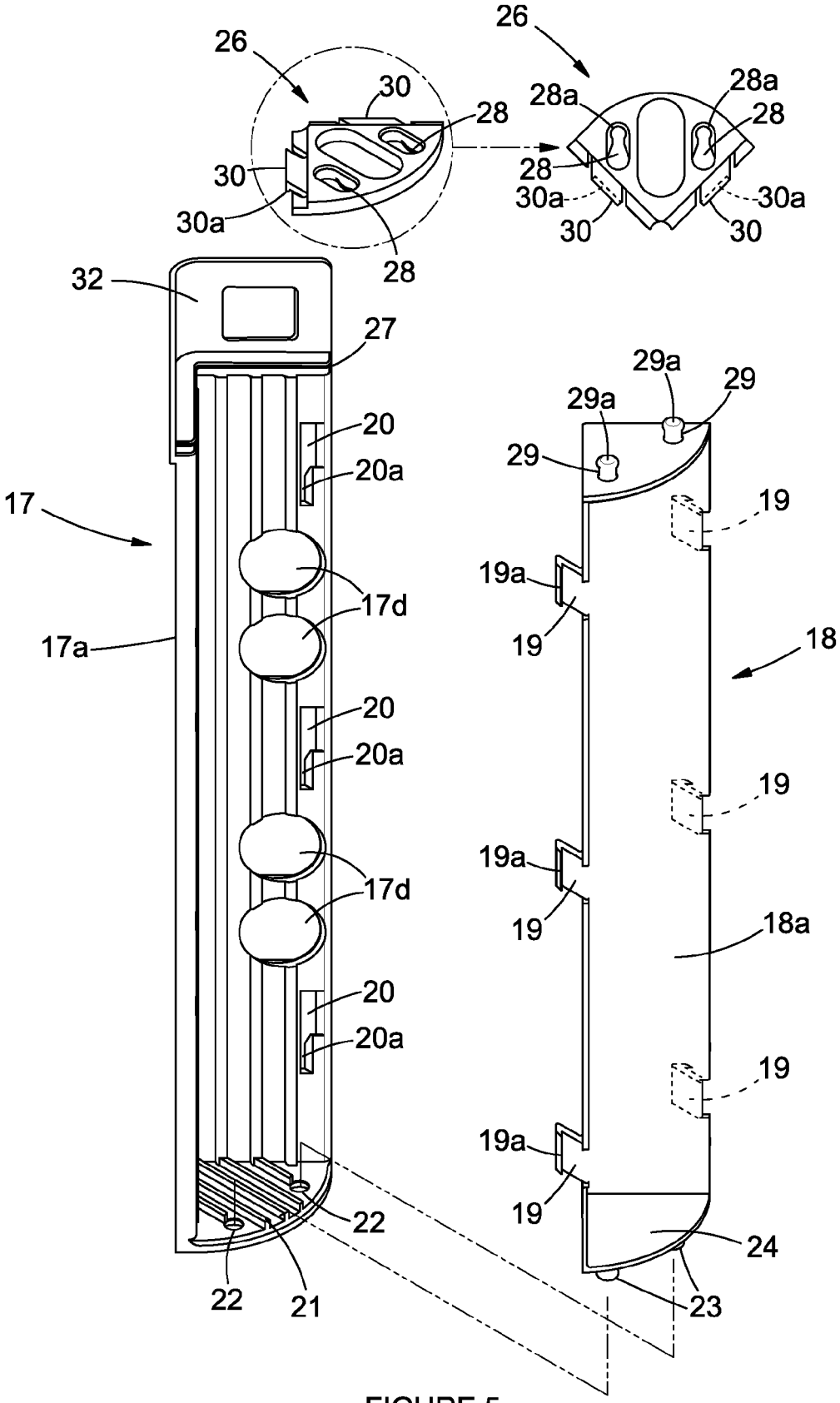
FIG. 5 is a schematic perspective view of an outer section and an inner section of a reinforcing corner post for use with the container in FIG. 2.
Figure 6:
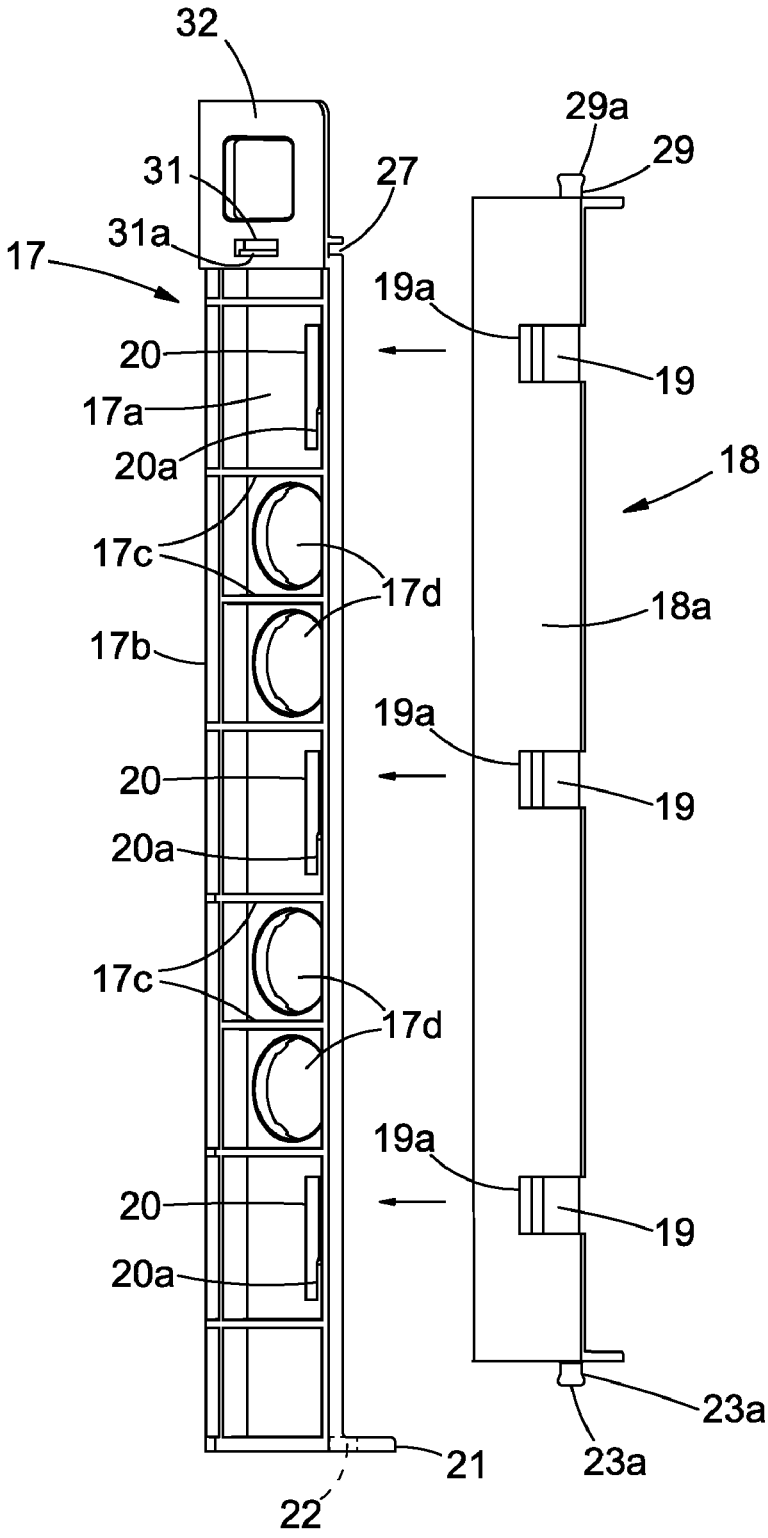
FIGS. 6 to 9 are schematic elevations of the outer section and the inner section of FIG. 5 illustrating the successive steps taken to couple together such sections to form a reinforcing corner post for the container in FIG. 2.
Figure 7:
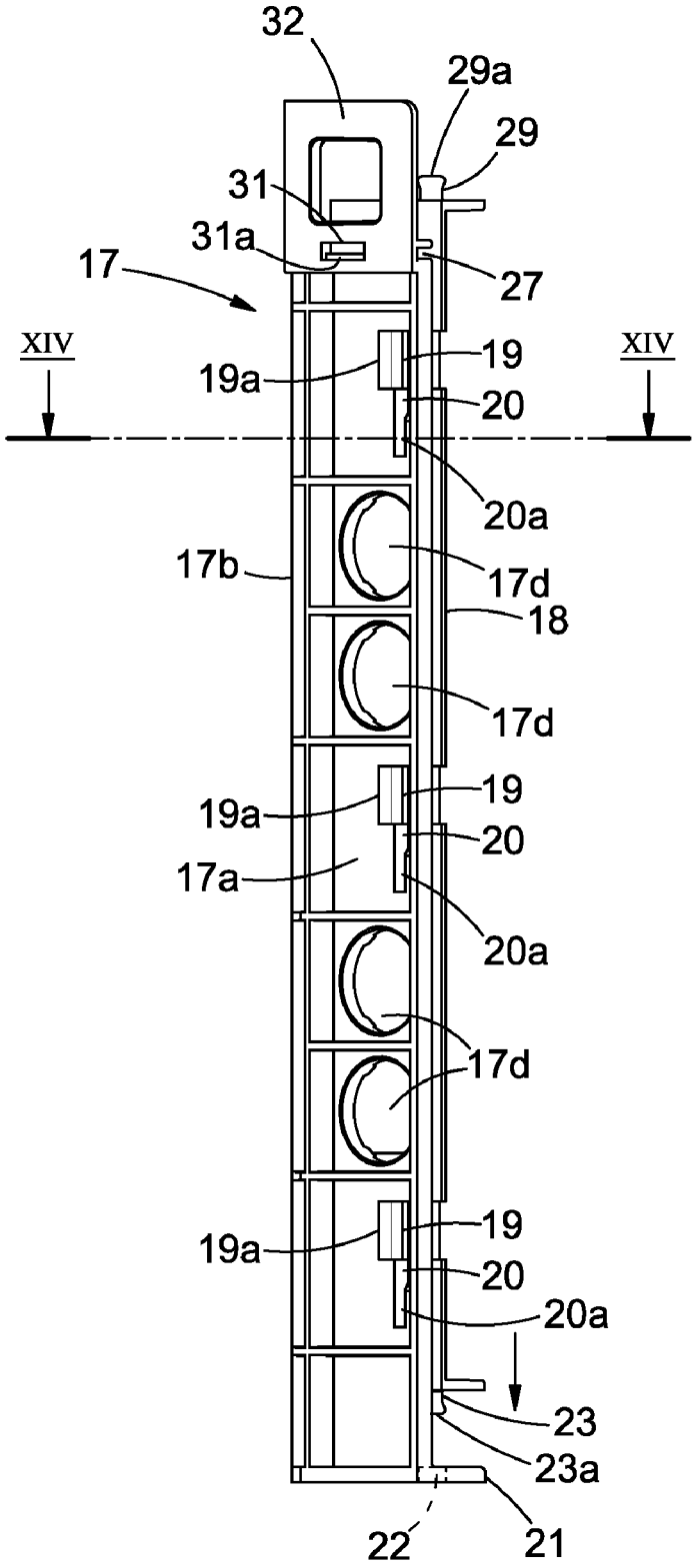

Also according to the invention, means are provided for providing a clip-in action when the inner and the outer post sections 17, 18 are moved to the engaged position. In a preferred arrangement, a low level platform in the form of a foot piece 21 is provided on a lower zone of the outer corner sections 17, and fits below a corner 14 of the container 13. The foot piece 21 defines one or more apertures 22 therein while corresponding spigots 23 extend from the inner post section 18 and engage the apertures 22 in a removable clip-in fashion. Preferably, the spigots 23 will extend from a similar foot piece 24 formed at the lower zone of the inner corner section 18 as shown in FIG. 5. It is envisaged that the spigots 23 will pass through apertures 25 in the corner of the base panel 10, (FIG. 1).

In the arrangement illustrated, the snap-in effect is created by providing head formations 23*a* at the extremities of the spigots 23 so that these engage a peripheral region on the apertures 22, and such peripheral region nests against a spigot formation 23 once the head formation 23*a* has passed through the apertures 22.

The invention further provides for a removable locking disc 26 to intersect the post sections 17, 18, when these are in the engaged position to prevent longitudinal movement of the sections 17, 18. Thus in one arrangement, a channel 27 will be formed at the upper zone of an outer corner section 17 along the inner periphery thereof, and extend slightly above the upper rim 14*a* of a corner 14. The channel 27 is adapted to receive a locking disc or plate 26 therein, such locking disc 26 acting to prevent relative longitudinal movement between the inner and the outer post sections 17, 18.

Figure 13:
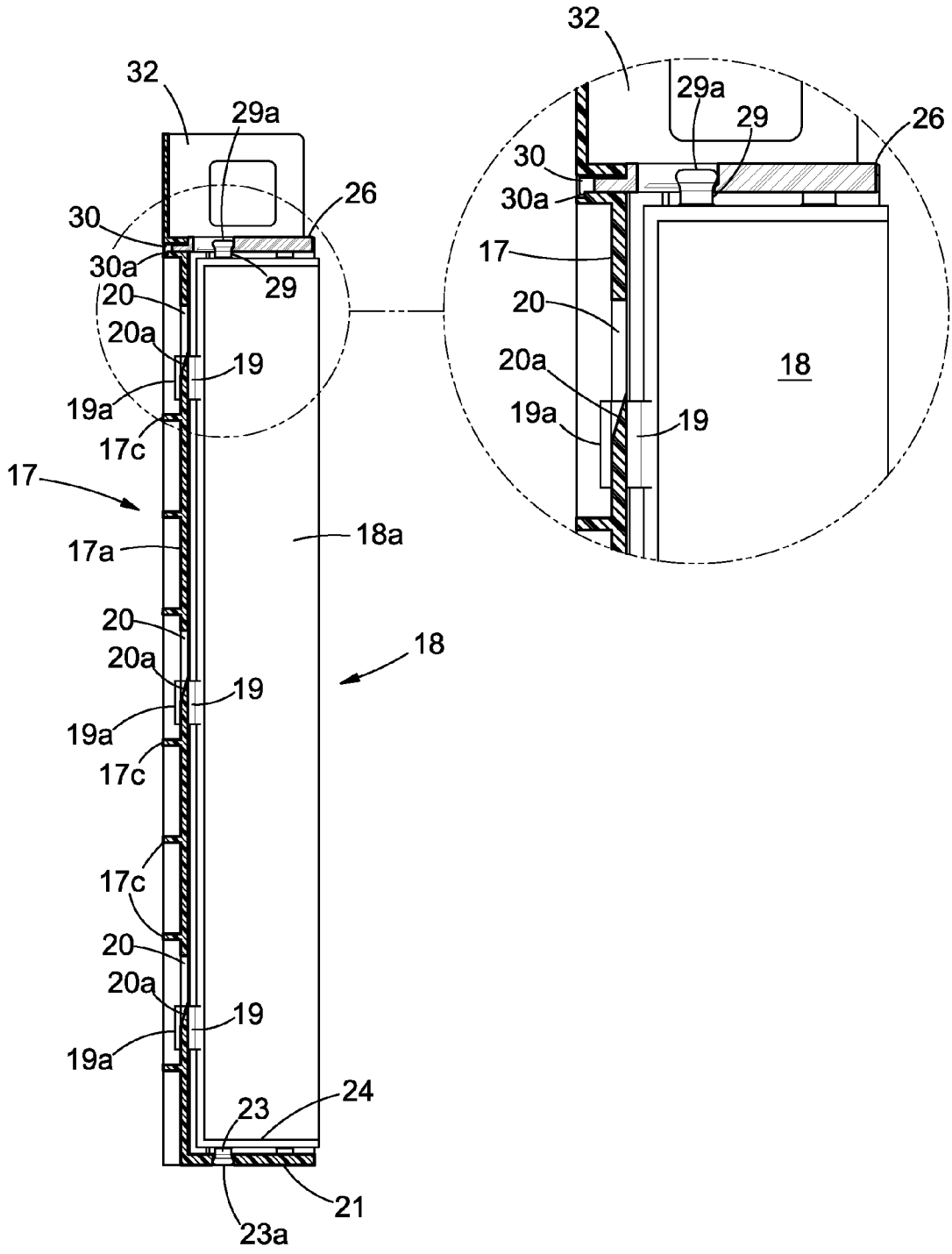
Figure 14:
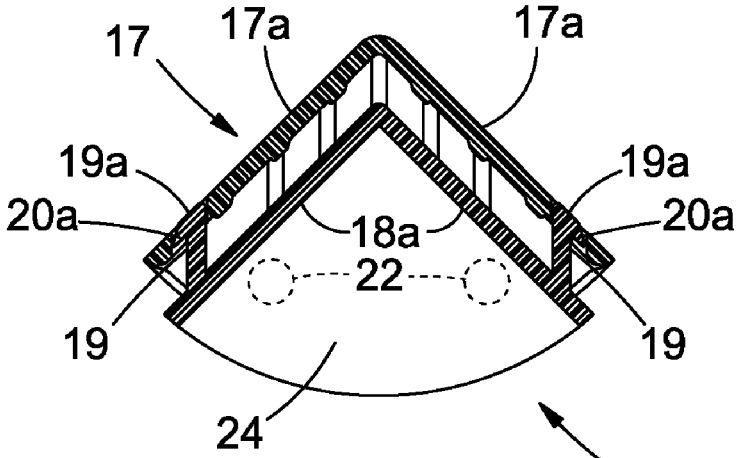
FIGS. 14 and 15 are schematic cross-sectional elevations of the corner post taken on lines XIV-XIV and XV-XV respectively in FIGS. 7 and 8 respectively.
Figure 15:
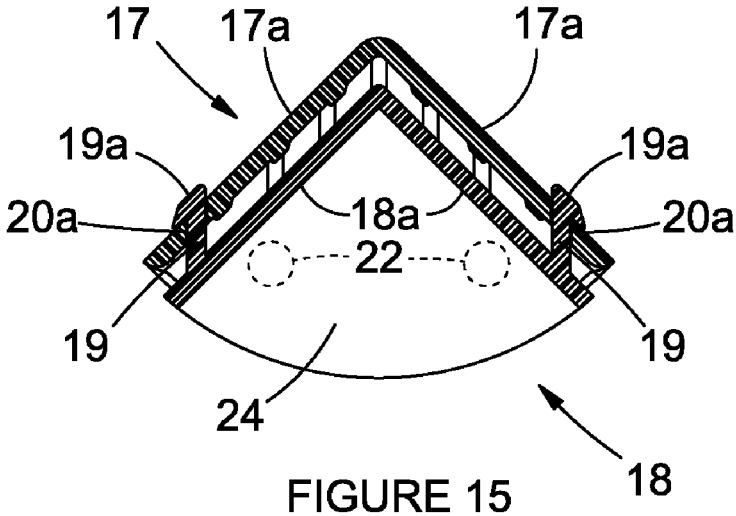

With reference to FIGS. 5, 8, 9, 12 and 13, the locking disc 26 will in a preferred arrangement, be provided with a forwardly extending tongue formation 30 provided on each part of its corner formation as shown in FIG. 5. Each tongue formation 30 will preferably terminate in a downwardly depending hook formation 30*a* which is adapted to engage a slot 31 which is provided with a matching step formation 31*a*. Thus when in position, a hook 30*a* of the tongue formation 30 will hook over the step 31*a* of the aperture 31 in the outer post section 17. It has been found that in this way the locking disc 26 cannot be removed from its locked position, unless the extension 32 of the outer post section 17 is slightly deformed. With reference to FIG. 13, the locking disc 26 will itself thus be removably locked in the position whilst it prevents longitudinal movement between the post sections 17, 18.

In one arrangement illustrated, the inner post section 18 may include two longitudinally extending spigot formations 29 in the same fashion as the bottom zone of the inner post section 18, so that the post section is in fact invertable. Thus, the upwardly extending spigot formations 29 will also terminate in head formations 29*a* which in use project through apertures 28 in the locking plate 26. Each aperture will preferably be provided with a web 28*a* therein which may narrow in plan view and then widen towards the curved end of the locking disc 26 (FIG. 5), so that a head formation 29*a* of a spigot formation 29 engages the web 28*a* to effect a snap type locking action when the locking plate is displaced to its locked position. There is thus a double locking of the locking disc 26 itself, firstly with the hook formations 30*a*, and secondly with the spigot formations 29 on the inner post section 18. Doubtless other arrangements are also possible, and it is envisaged that these all fall within the scope of the invention.

Figure 9:
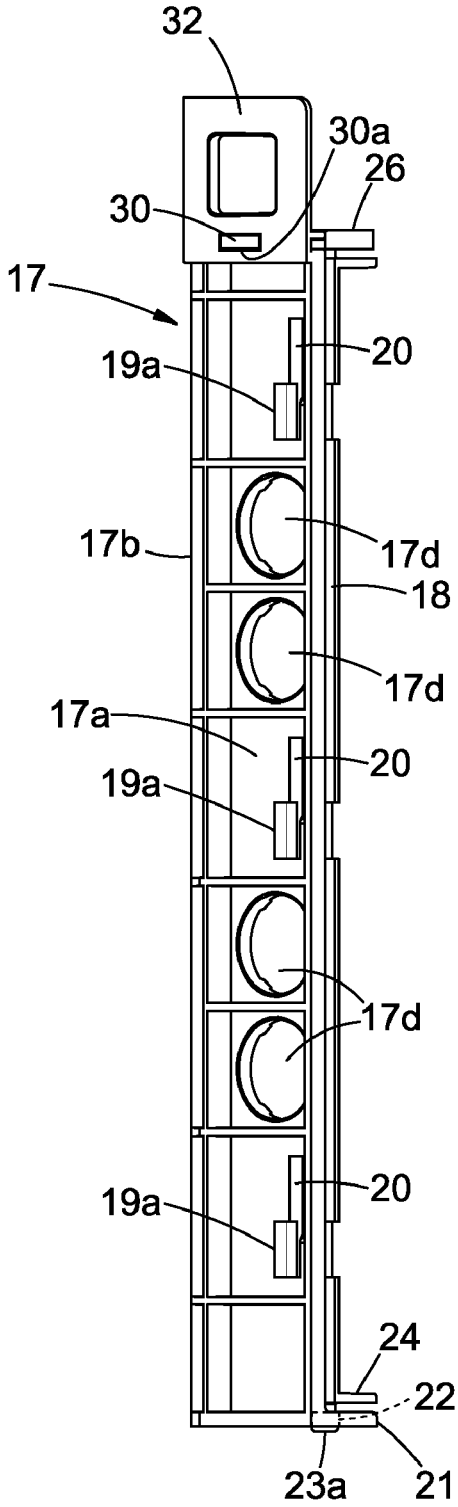

In order to disassemble a corner post from its locked position shown in FIG. 9, it is required to displace the locking disc 26 horizontally to release it from the spigot formations 29 on the inner post section 18 and thereafter to lift the inner post section 18 relative to the outer post section 17 in a sliding movement, thereby releasing the tongues 19 from engagement in the slot formations 20. Once thus released, the inner post section 18 can be withdrawn laterally from the outer post section 17.

It has been found that with the novel arrangement of the invention, the erection and disassembly of the container 13 can readily be automated. In particular, both the assembly and the disassembly of the container 13 are facilitated.

It is a further feature of the invention that each or selected assembled corner posts may form an upwardly protruding stacking corner 32 within which the base of an overlying similar container is receivable (FIG. 4). Such an arrangement is illustrated in the drawings wherein a longitudinal extension 32 is provided on the outer reinforcing post section 17 which protrudes upwardly from the assembled reinforcing post member.

Doubtless, variations in detail of the invention exist without departing from the principles set forth in the appended claims.

The invention claimed is:

1. A reinforcing corner post suitable for a container, the reinforcing corner post being suitable to be provided at all or selected corners of the container, the corner post having an external post section which is adapted to embrace the corner, and an internal post section which is adapted to nest within the corner, and engaging means for releasably coupling the external post section and internal post section to one another by longitudinal displacement of the external post section and internal post section relative to one another to an engaged position, and the corner post further having locking means configured and operative for securing the internal post section and the external post section in the engaged position and further configured and operative to prevent relative longitudinal displacement of the internal post section and the external post section, the locking means being removable from the internal and the external post sections to release the internal and external post sections to allow for disengagement of the internal post section and the external post section from one another, wherein the locking means for securing the internal post section and the external post section in the engaged position comprises a disc which is receivable in a channel which follows the inner periphery of the external post section and against which disc the internal post section abuts to prevent relative longitudinal displacement between the internal post section and the external post section.

2. The corner post according to claim 1 wherein the internal post section and the external post section each comprise generally planar longitudinally extending leaf elements which are angled relative to one another, meeting at a longitudinal junction to define a corner formation.

3. The corner post according to claim 2 wherein the leaf elements include transverse and/or longitudinal reinforcing ribs.

4. The corner post according to claim 1 wherein the engaging means comprises tongue elements which extend from one post section and engage complementary formations in the other post section upon relative longitudinal displacement between such sections.

5. The corner post according to claim 4 wherein the tongue elements extend outwardly from the inner post section and engage corresponding longitudinal slots provided in the outer post section.

6. The corner post according to claim 4 wherein the tongue elements extend from the inner post sections and each tongue element terminates in a head formation which is adapted to be held captive by a corresponding slot in the other post section upon relative longitudinal displacement between the post sections to the engaged position.

7. The corner post according to claim 6 wherein at least some of the slots which engage the head formations of the tongue elements include a ramp section which acts to draw a tongue element into a slot formation to a greater depth.

8. The corner post according to claim 1 wherein the internal post section and the external post section are drawn closer together so as to sandwich a corner of the container within the embrace of the post sections.

9. The corner post according to claim 1 wherein the external post section is provided with a low level platform structure which is adapted to extend beneath a corner of the container, and which is provided with an engagement formation which is engaged by a corresponding engagement formation on the internal post section when the internal and the external post sections are in the engaged position.

10. The corner post according to claim 9 wherein the engagement formation on the platform structure is in the nature of one or more apertures which, in use, receive spigots therein which extend from the internal post section and which have outwardly directed collars which clip into the apertures.

11. The corner post according to claim 1 wherein the locking means is provided with retention means for locking the disc in position on the corner post.

12. The corner post according to claim 1 wherein the locking means comprises a hook formation which engages a step structure provided in the channel.

13. The corner post according to claim 1 wherein the disc has apertures through which upstanding spigot formations on the internal post section extend and which engage the spigot formations in a snap type locking action.

14. The corner post according to claim 1 wherein the external post sections include upper extensions so that these project above the upper level of the container to constitute stacking corners within which the lower zone of an overlying container is receivable.

15. A reinforcing corner post and a container, the container comprising a foldable blank having a base panel and a pair of opposed side wall panels, and a pair of opposed end wall panels, the side wall panels and end wall panels being foldable into upright positions relative to the base panel to define opposed side walls and end walls with corners being formed at the junctions of the side walls and end walls, the reinforcing corner post being provided at all or selected corners of the container, the corner post having an external post section which embraces the corner, and an internal post section which nests within the corner, and engaging means for releasably coupling the external post section and internal post section to one another by longitudinal displacement of the external post section and internal post section relative to one another to an engaged position, and the corner post further having locking means configured and operative for securing the internal post section and the external post section in the engaged position and further configured and operative to prevent relative longitudinal displacement of the internal post section and the external post section, the locking means being removable from the internal and the external post sections to release the internal and external post sections to allow for disengagement of the internal post section and the external post section from one another.

* * * * *